US008414431B2

(12) United States Patent
Chung et al.

(10) Patent No.: US 8,414,431 B2
(45) Date of Patent: Apr. 9, 2013

(54) TABLE TENNIS BALL STORAGE APRON

(75) Inventors: Safari Chung, Taipei (TW); David Lee Julian, Evansville, IN (US)

(73) Assignee: Indian Industries, Inc., Evansville, IN (US)

( * ) Notice: Subject to any disclaimer, the term of this patent is extended or adjusted under 35 U.S.C. 154(b) by 201 days.

(21) Appl. No.: 12/957,460

(22) Filed: Dec. 1, 2010

(65) Prior Publication Data

US 2012/0142459 A1 Jun. 7, 2012

(51) Int. Cl.
*A63B 67/04* (2006.01)

(52) U.S. Cl. ..... 473/496

(58) Field of Classification Search ..... 473/496; 206/315.9; 52/11
See application file for complete search history.

(56) References Cited

U.S. PATENT DOCUMENTS

| | | | | | |
|---|---|---|---|---|---|
| 20,155 | A | * | 5/1858 | Henderson | 248/48.1 |
| 190,382 | A | * | 5/1877 | Snyder | 52/16 |
| 263,046 | A | * | 8/1882 | Huth | 52/11 |
| 559,942 | A | * | 5/1896 | Horan | 52/11 |
| 664,660 | A | * | 12/1900 | May | 52/95 |
| 2,569,007 | A | * | 9/1951 | Klyce | 108/170 |
| 2,640,697 | A | | 6/1953 | Elersich | |
| 3,410,556 | A | | 11/1968 | Kaiser et al. | |
| 3,495,825 | A | | 2/1970 | Nielsen | |
| 3,853,316 | A | * | 12/1974 | Smith | 473/496 |
| 4,211,406 | A | | 7/1980 | Roesler et al. | |
| 5,472,189 | A | | 12/1995 | Pfeiffer et al. | |
| 5,632,386 | A | | 5/1997 | Gabhart | |
| 5,810,681 | A | * | 9/1998 | Heim | 473/496 |
| 5,820,499 | A | * | 10/1998 | Thomas et al. | 473/496 |
| 6,050,625 | A | * | 4/2000 | Nisbet | 294/19.2 |
| 2012/0142459 | A1 | * | 6/2012 | Chung et al. | 473/496 |

* cited by examiner

*Primary Examiner* — Raleigh W Chiu
(74) *Attorney, Agent, or Firm* — Woodard, Emhardt, Moriarty, McNett & Henry LLP

(57) ABSTRACT

Certain embodiments comprise a table tennis table having a table tennis surface defined by two table halves and separated by a net. Each table half has an upper playing surface, a width defined between opposing side edges and a player end arranged along the width. In one embodiment, the table tennis table includes a ball storage rack having a length mounted along the width of at least one table half adjacent the player end, wherein the ball storage rack is configured to support a plurality of table tennis balls. The ball storage rack defines a gap along its length, wherein the gap faces outward from the player end and has a size sufficient to allow table tennis balls to be selectively removed through the gap.

15 Claims, 6 Drawing Sheets

TABLE TENNIS BALL STORAGE APRON

FIELD OF THE INVENTION

Certain embodiments of the present invention relate to table tennis table assemblies.

BACKGROUND OF THE INVENTION

Table tennis tables are known for recreation or competition. As is well known, during game play or practice a player typically uses a table tennis paddle to propel a table tennis ball over the table, preferably into a desired target area on the opposing half of the table. Play with respect to a particular serve often ends when a ball has missed the table on one side or the other and may roll or bounce away from the table. Retrieving a ball which has rolled or bounced away from the table can disrupt game play, taking time and effort. Sometimes rather than immediately retrieving a ball, additional balls may be selected for use from a storage rack, typically mounted alongside or near yet separate from the table tennis table. Retrieving a ball from such a rack can also take additional time. Many such racks require additional hardware which protrudes from the table or which must be stored separately.

An improved table tennis table and storage rack is desired.

SUMMARY

Certain embodiments comprise a table tennis table having a table tennis surface defined by two table halves and separated by a net. Each table half has an upper playing surface, a width defined between opposing side edges and a player end arranged along the width. In one embodiment, the table tennis table includes a ball storage rack having a length mounted along the width of at least one table half adjacent the player end, wherein the ball storage rack is configured to support a plurality of table tennis balls. The ball storage rack defines a gap along its length, wherein the gap faces outward from the player end and has a size sufficient to allow table tennis balls to be selectively removed through the gap.

A combination according to some embodiments includes a table tennis table piece having an upper playing surface, a width defined between opposing side edges and a player end arranged along the width. The embodiments also include a ball storage rack which has a length mounted in a substantially horizontal arrangement along the width of the table piece. The ball storage rack defines a gap along its length facing outward from said player end. The ball storage rack is configured to support a plurality of table tennis balls along the length of the ball storage rack and the gap has a size sufficient to allow table tennis balls to be selectively removed through the gap in a direction transverse to the length of the ball storage rack.

In another embodiment, a ball storage rack consists of a rack portion defining a length and configured to support a plurality of table tennis balls within a portion extending along the length between an outer lip and a backwall. The backwall is configured to be secured to the underside of a table tennis table piece. The outer lip has a height such that when the rack is secured to the table tennis table piece the outer lip defines a gap along the length of said rack between said ball storage rack and said table piece sufficient to allow table tennis balls to be selectively added or removed through said gap.

Further objects and advantages of the embodiments will be apparent from the disclosed figures and description.

DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

Figure 1:
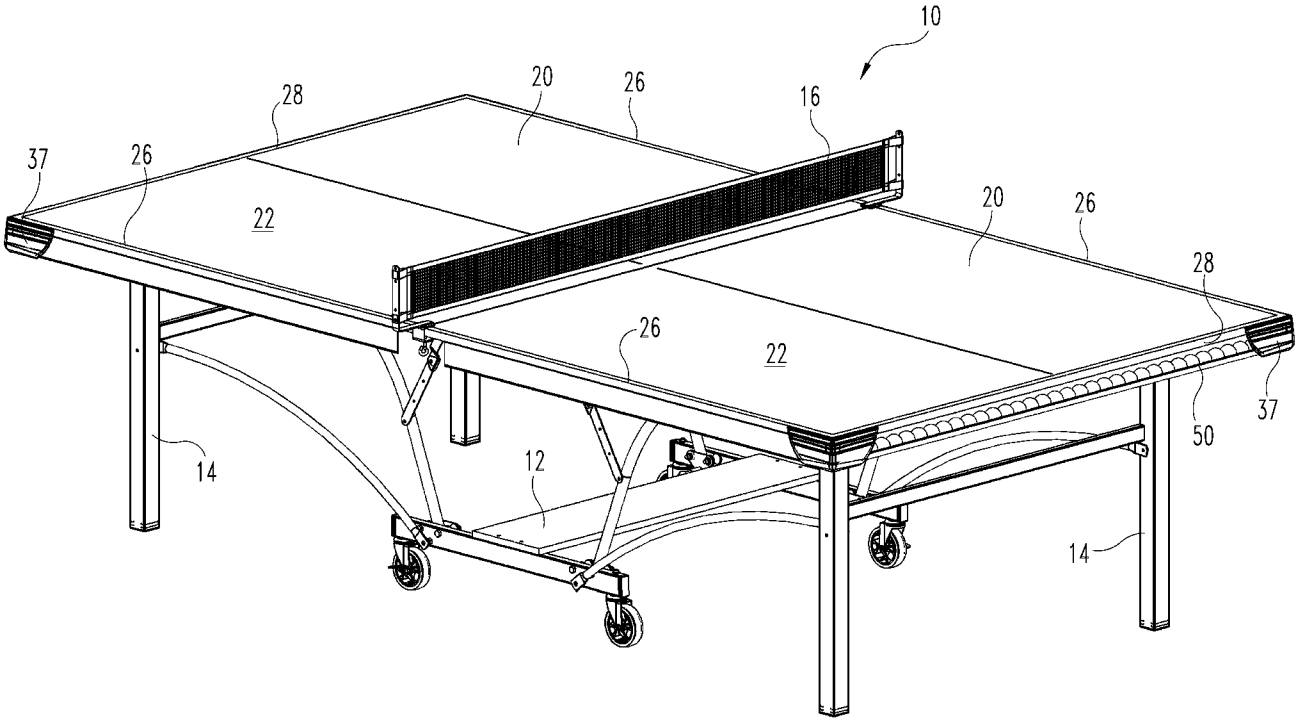
FIG. 1 is a perspective view of a table tennis table according to certain preferred embodiments of the present disclosure.
Figure 2:
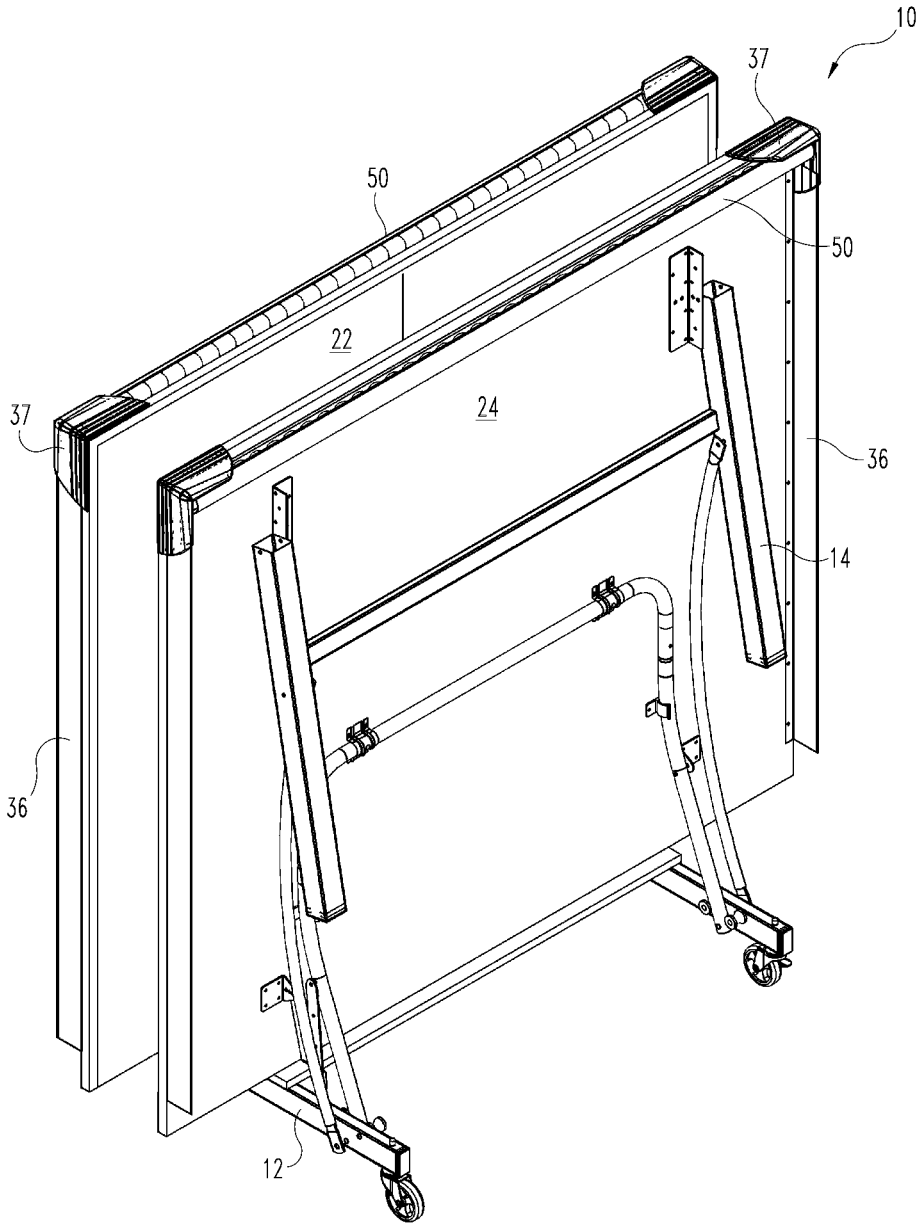
FIG. 2 is a perspective view of a table tennis table of FIG. 1 in a closed position.

FIG. 1 illustrates a perspective view of a table tennis table 10 having two table halves. A table tennis table may be one continuous piece separated by a net into two table halves, or alternately, as illustrated, may be two separate table tennis half pieces 20 separated by net 16. A support system, for example including center supports 12 and outer supports 14, typically supports the table halves in an open playing configuration with the table halves in a horizontal arrangement. In certain embodiments, as illustrated in FIG. 2, the table tennis halves may be moved or folded into a storage arrangement with the table tennis halves arranged substantially vertically. The support system commonly includes exterior corner legs and a central carriage or legs attaching the first table half to the second table half. The legs and carriage may be foldable to allow the table halves to be rotated to an upright orientation for storage or movement. The legs or carriage may include castors or wheels.

A storage rack such as rack 50 can be mounted at one or both ends of a table tennis table 10 to hold a plurality of table tennis balls 18. The racks preferably retain and hold the table tennis balls from escaping in the table's open position and also after the table tennis halves have been rotated into a substantially vertical storage position.

In certain preferred embodiments, the proportions and stripes of table 10 are sized to be consistent with regulation dimensions sponsored by USA Table Tennis and the International Table Tennis Federation. For purposes of illustration, example dimensions are given as follows, although it will be understood that dimensions can be varied by those of skill in the art without departing from the spirit of the present invention. In the example of table 10, the width of the table and table halves is 60 inches (1.525 m) with the longitudinal length of each half being 54 inches respectively (total of 2.74 m) at a height of 30 inches (76 cm). The table sections are illustrated with a thickness of ¾ of an inch (1.9 cm). The perimeter stripes have a width of 25/32 (2 cm). The central stripe has width of 3 mm for regulation play, yet commonly has a width of ⅜ of an inch (9.5 mm) for recreational play. Options to apply the stripes include screen printing or tape, although printing is preferred.

Directional references herein are intend for convenience only and are not intended to be limiting. For orientation, each table half is referred to as having two longitudinal side edges also referred to as outer edges, with inward referring to a direction toward the center of the table half. The playing surface defines a top or upward direction.

For brevity, one table half will be described and illustrated in detail. The second table half is typically substantially identical in structure and arranged substantially symmetrically to the first table half.

Figure 3:
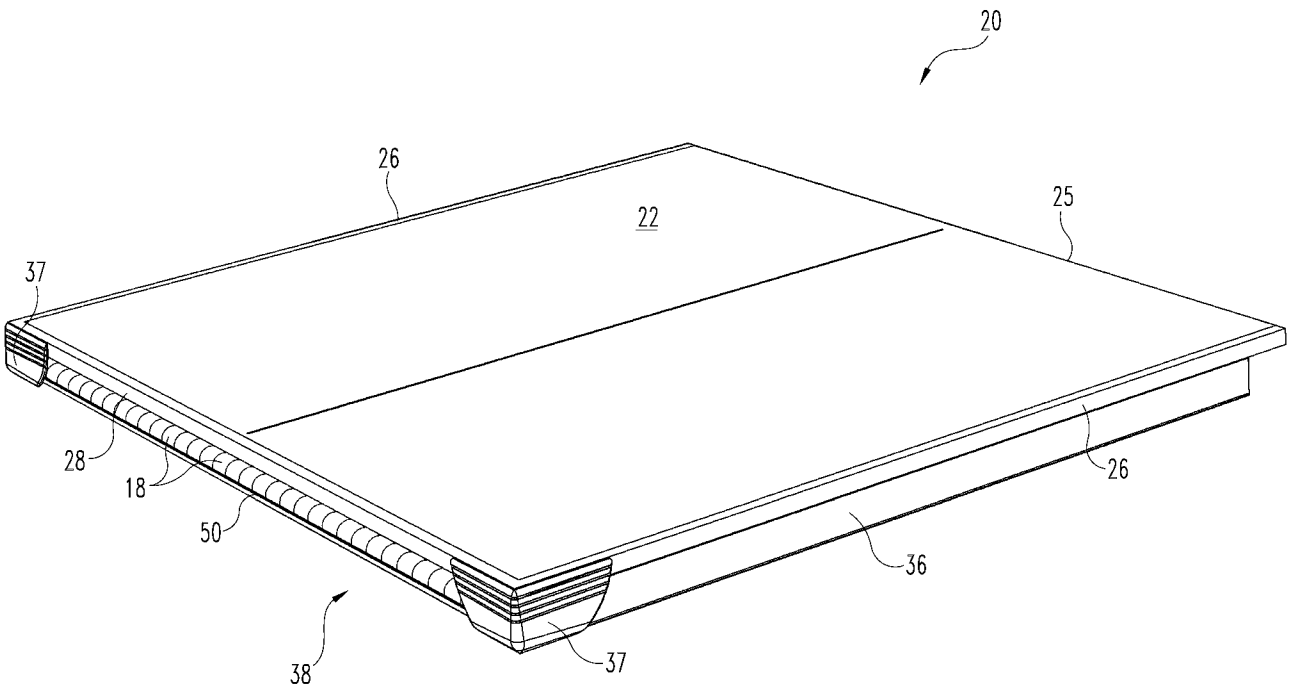
FIG. 3 is a perspective view of one table half of the embodiment FIG. 1.
Figure 4:
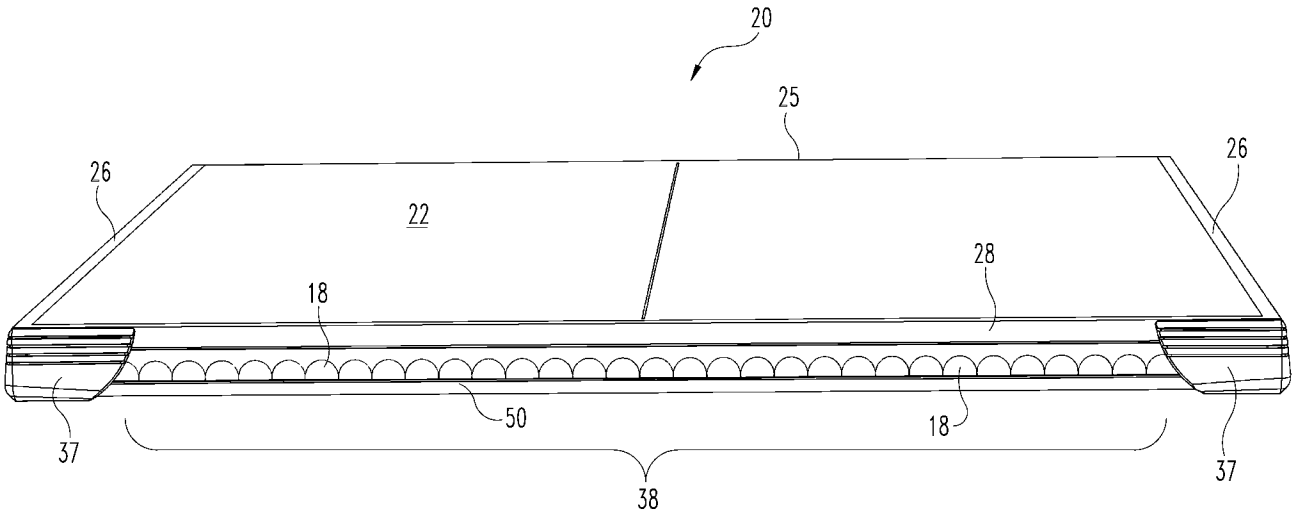
FIG. 4 is an end, perspective view of the table half of FIG. 3.
Figure 5:
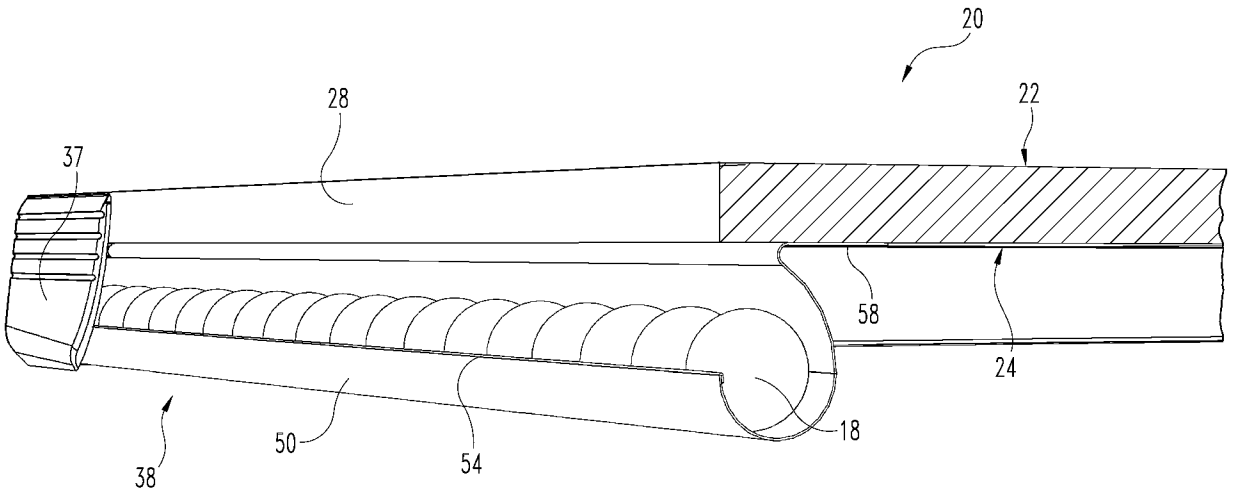
FIG. 5 is a partial, cross-sectional view of the table half of FIG. 3.

As illustrated in FIGS. 3-5, a table half is typically formed of a half table piece 20 defining an upper playing surface 22 and having a lower surface 24. Parallel side edges 26 extend along the edges of the half and are substantially perpendicular to center or net edge 25. Opposite and parallel to net edge 25 is a player end 28. In certain embodiments, the table half includes side rails 36 extending along and slightly downward from side edges 26 and corner bumpers 37 extending around and slightly downward along the corners between side edges 26 and player end 28. Bumpers 37 are preferably made from a resilient material, such as rubber, to reduce the risk of injury during accidental impact.

Storage rack 50 is preferably arranged substantially horizontally and adjacent to yet underneath the edge of player end 28. Storage rack 50 is preferably configured to retain and hold a plurality of table tennis balls from undesired movement such as dropping, yet has a side-opening face or gap along its length which allows a player to view the balls present and to selectively add or remove available table tennis balls 18 when desired. In certain embodiments, rack 50 is arranged within a gap 38 along the width of table half 20 between opposing corner bumpers 37. In alternate embodiments, storage rack 50 can be arranged adjacent to yet underneath one or more side edges 26.

In certain embodiments, storage rack 50 defines a length, which when mounted extends substantially across the width of table half piece 20. In alternate embodiments, storage rack 50 includes a length extending at least across the center point of the width of table half piece 20, typically designated by a center playing stripe marked on playing surface 22.

Figure 6:
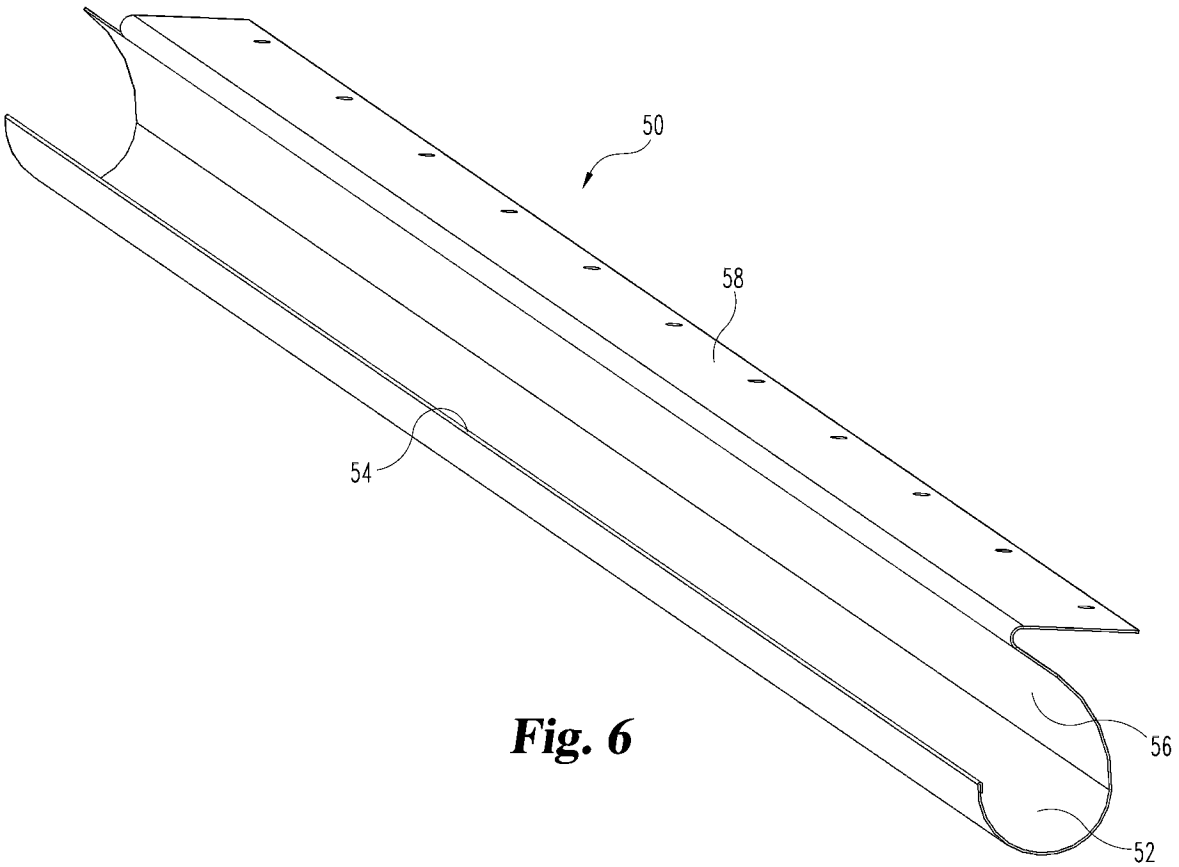
FIG. 6 is a perspective view of a storage rack usable in the embodiment of FIG. 3.

The details and mounting of storage rack 50 are illustrated in further detail in FIGS. 5 and 6. Rack 50 preferably defines a longitudinal storage portion extending in a shelf type of arrangement along the length of the rack such as a concave arcuate gutter portion 52. This portion is configured to receive and is sized to loosely correspond to the diameter of a table tennis ball. Table tennis balls 18 may be loose to roll along the length of the storage portion, or may be urged to remain in place, for example with a friction fit or spherical dimples.

The rack 50 may have end stops to prevent balls from rolling out, or the ends may be arranged adjacent side rails 36 or bumpers 37 to close the ends. The storage portion of rack 50 is arranged between a front or outer lip 54 and a back or rear wall 56. Rear wall 56 extends upward to a mounting flange 58 which can be secured to lower surface 24 of the table tennis half piece 20.

Preferably, when mounted, the height of outer lip 54 relative to the height of back wall 56 defines a gap along the length of rack 50 between lip 54 and lower surface 24 of the table to allow access to add and remove table tennis balls when desired. Preferably a plurality of table tennis balls 18 are displayed side-by-side on a shelf type of arrangement along the length axis of the rack and are accessible so that a player can view multiple balls at the same time. The player can then choose to individually select and remove one or more of the available balls. The side-opening gap allows table tennis balls to be selectively added or removed through said gap in a direction transverse to the length of the ball storage rack. In preferred embodiments, the gap will have a diameter at least equal to and preferably at least slightly larger than the diameter of a regulation table tennis ball.

In certain preferred embodiments, rack 50 is formed of a rigid material, such as a rolled piece of metal, wood or a molded plastic material which can be rigidly secured to the lower surface 24 of the table half. In the example embodiment, mounting flange 58 can be secured in multiple locations to the lower surface of the table tennis half in a manner to add rigidity to the table tennis half to minimize warping of the table.

In certain embodiments, for example if the table tennis half is formed of two joined quarter sections, rack 50 may span and provide rigidity to a joint between the quarter sections. In certain embodiments, rack 50 may be substantially rigid along the width of player end 28 yet may have some flexibility to be bent or pushed slightly inward or outward toward or away from the net for flexibility in use and to minimize the force of an accidental impact.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A table tennis table, comprising:

a. a table tennis surface defined by two table halves separated by a net;

b. each table half having an upper playing surface, a width defined between opposing side edges and a player end arranged along said width;

c. a ball storage rack having a length mounted along the width of at least one table half adjacent said player end, wherein said ball storage rack is configured to support a plurality of table tennis balls;

d. said ball storage rack defining a gap along its length, wherein said gap faces outward from said player end and wherein said gap has a size sufficient to allow table tennis balls to be selectively removed through said gap.

2. The table of claim 1, wherein said ball storage rack is mounted to a lower side of said table half and is mounted adjacent the outer edge of said table half along said player end.

3. The table of claim 1, wherein said ball storage rack is mounted to said table half in a substantially horizontal arrangement.

4. The table of claim 1, wherein the length of said ball storage rack extends along a least a majority of the width of said table half.

5. The table of claim 1, wherein the length of said ball storage rack extends across a midpoint of said table half.

6. The table of claim 1, wherein said ball storage rack is rigid and is rigidly secured to said table half along a least a majority of the width of said table half.

7. The table of claim 1, wherein said ball storage rack includes a concave portion arranged between an outer lip and a backwall, wherein said backwall is secured to the underside of said table half, and wherein said gap is formed by the distance between said outer lip and said table half, and wherein multiple table tennis balls are viewable in said gap so that a player may individually select and remove one or more of the available balls.

8. The table of claim 7, wherein said ball storage rack is rigid and is rigidly secured to said table half along a least a majority of the width of said table half.

9. The table of claim 1, wherein said table is formed of two separate half pieces which can be folded from an open playing configuration wherein said table half pieces are substantially horizontal to closed configuration wherein said table half pieces are substantially vertical and wherein said ball storage rack is at an upper end of said table half piece in the closed configuration.

10. A combination, comprising:

a. a table tennis table piece having an upper playing surface, a width defined between opposing side edges and a player end arranged along said width;

b. a ball storage rack having a length mounted in a substantially horizontal arrangement along the width of said table piece, said ball storage rack defining a gap along its length facing outward from said player end; and, c. wherein said ball storage rack is configured to support a plurality of table tennis balls along the length of said ball storage rack and wherein said gap has a size sufficient to allow table tennis balls to be selectively removed through said gap in a direction transverse to the length of said ball storage rack.

11. The combination of claim 10, wherein said ball storage rack is mounted to a lower side of said table piece and is mounted adjacent the outer edge of said table piece along said player end.

12. The combination of claim 10, wherein the length of said ball storage rack extends along a least a majority of the width of said table piece.

13. The combination of claim 10, wherein the length of said ball storage rack extends across a midpoint of said table piece.

14. The combination of claim 10, wherein said ball storage rack is rigid and is rigidly secured to said table piece along a least a majority of the width of said table piece.

15. The combination of claim 10, wherein said ball storage rack includes a concave portion arranged between an outer lip and a backwall, wherein said backwall is secured to the underside of said table piece and wherein said gap is defined between said outer lip and said table piece.

* * * * *

US008414431C1

(12) EX PARTE REEXAMINATION CERTIFICATE (10210th)

United States Patent
Chung et al.

(10) Number: US 8,414,431 C1
(45) Certificate Issued: Jun. 27, 2014

(54) TABLE TENNIS BALL STORAGE APRON

(75) Inventors: Safari Chung, Taipei (TW); David Lee Julian, Evansville, IN (US)

(73) Assignee: Indian Industries, Inc., Evansville, IN (US)

Reexamination Request:
No. 90/013,067, Nov. 27, 2013

Reexamination Certificate for:

| | |
|---|---|
| Patent No.: | **8,414,431** |
| Issued: | **Apr. 9, 2013** |
| Appl. No.: | **12/957,460** |
| Filed: | **Dec. 1, 2010** |

(51) Int. Cl.
*A63B 67/04* (2006.01)

(52) U.S. Cl.
USPC ..... 473/496

(58) Field of Classification Search
None
See application file for complete search history.

(56) References Cited

To view the complete listing of prior art documents cited during the proceeding for Reexamination Control Number 90/013,067, please refer to the USPTO's public Patent Application Information Retrieval (PAIR) system under the Display References tab.

*Primary Examiner* — Joseph A. Kaufman

(57) ABSTRACT

Certain embodiments comprise a table tennis table having a table tennis surface defined by two table halves and separated by a net. Each table half has an upper playing surface, a width defined between opposing side edges and a player end arranged along the width. In one embodiment, the table tennis table includes a ball storage rack having a length mounted along the width of at least one table half adjacent the player end, wherein the ball storage rack is configured to support a plurality of table tennis balls. The ball storage rack defines a gap along its length, wherein the gap faces outward from the player end and has a size sufficient to allow table tennis balls to be selectively removed through the gap.

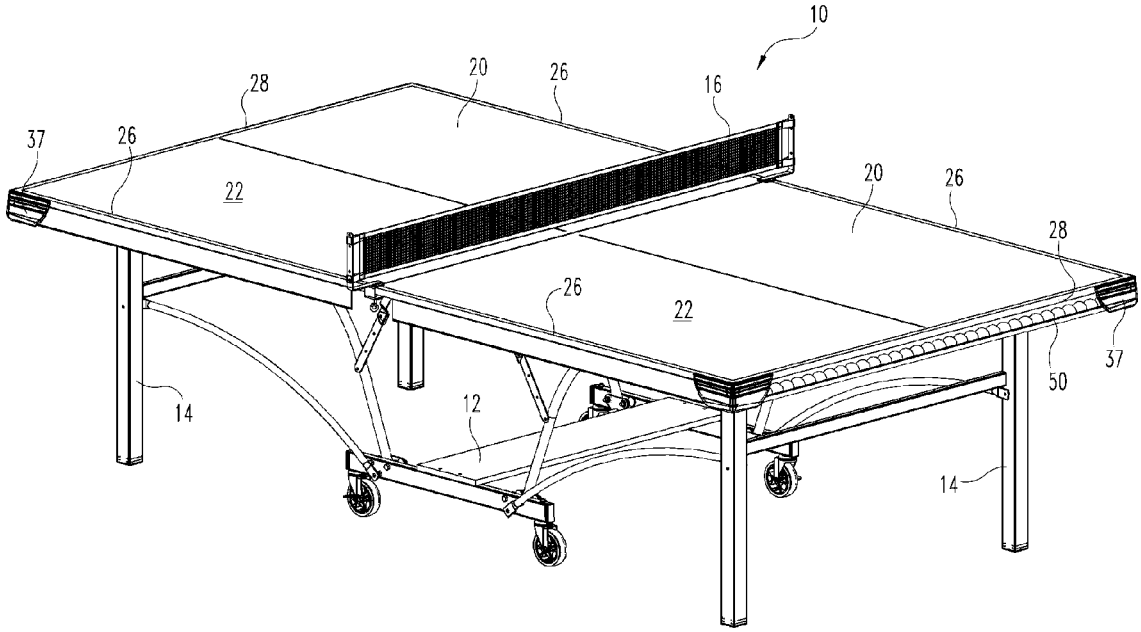

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4 and 12-14 are cancelled.

Claims 1 and 10 are determined to be patentable as amended.

Claims 2, 3, 5-9, 11 and 15, dependent on an amended claim, are determined to be patentable.

New claims 16-18 are added and determined to be patentable.

1. A table tennis table, comprising:

a. a table tennis surface defined by two table halves separated by a net;

b. each table half having an upper playing surface, a width defined between opposing side edges and a player end arranged along said width;

c. a ball storage rack having a length mounted along the width of at least one table half adjacent said player end, wherein said ball storage rack is configured to support a plurality of table tennis balls *and extends along a least a majority of the width of said table half*;

d. said ball storage rack defining a gap along its length, wherein said gap faces outward from said player end and wherein said gap has a size sufficient to allow table tennis balls to be selectively removed through said gap.

10. A combination, comprising:

a. a table tennis table piece having [an] *a horizontal* upper playing surface *separated into two separate sides by a vertical net*, a width defined between opposing side edges and a player end arranged along said width, *and two corner bumpers, each corner bumper covering a corner where one of said opposing side edges meets said player end, wherein each of said two corner bumpers has an inside edge along said player end and an outside edge along one of said opposing side edges*;

b. a ball storage rack having a length mounted in a substantially horizontal arrangement along the width of said table piece, said ball storage rack *extending the entire length between the inner edges of said corner bumpers and* defining a gap along its length facing outward from said player end; and, c. wherein said ball storage rack is configured to support a plurality of table tennis balls along the length of said ball storage rack and wherein said gap has a size sufficient to allow table tennis balls to be selectively removed through said gap in a direction transverse to the length of said ball storage rack.

*16. A table tennis table, comprising:*

*a. a table tennis surface defined by two separate table halves separated by a net, said two table halves capable of being folded from an open playing configuration wherein said table half pieces are substantially horizontal to a closed configuration wherein said table half pieces are substantially vertical;*

*b. each table half having an upper playing surface, a width defined between opposing side edges and a player end arranged along said width;*

*c. a ball storage rack having a length mounted along the width of at least one table half along said player end, wherein said ball storage rack is configured to support a plurality of table tennis balls; and*

*d. said ball storage rack having an arcuate cross-section of greater than 180 degrees along its length when viewed in a direction parallel to said player end, wherein said arcuate shape includes a gap along its length which faces outward from said player end and wherein said gap has a size sufficient to allow table tennis balls to be selectively removed through said gap.*

*17. The table tennis table of claim 16, wherein said ball storage rack includes an arcuate portion extending above and over the surface of a table tennis ball contained therein when said table tennis table is in its open playing configuration.*

*18. A table tennis table, comprising:*

*a. a table tennis surface defined by two table halves separated by a net;*

*b. each table half having an upper playing surface, a width defined between opposing side edges and a player end arranged along said width;*

*c. a ball storage rack having a length mounted along the width of at least one table half adjacent said player end, wherein said ball storage rack is configured to support a plurality of table tennis balls;*

*d. said ball storage rack formed from plastic and having an arcuate cross-section greater than 180 degrees along its length when viewed in a direction parallel to said player end, and a mounting flange extending rearward from an end of said arcuate portion;*

*e. wherein said arcuate cross-section has a diameter sized to correspond to the diameter of a table tennis ball; and*

*f. wherein said rack defines a gap along its length between a front lip and the underside of one of said separate table halves which faces outward from said player end when said mounting flange is mounted flush to the underside of one of said separate table halves near said player end, and wherein said gap has a size sufficient to allow table tennis balls to be selectively removed through said gap.*

* * * * *